US006082278A

United States Patent [19]

Asao et al.

[11] Patent Number: 6,082,278

[45] Date of Patent: Jul. 4, 2000

[54] BOBBIN CASE AND BOBBIN OF SEWING MACHINE

[75] Inventors: Hideo Asao; Takasi Wakabayasi, both of Tokyo; Masuo Takami, Osaka, all of Japan

[73] Assignee: Canon Kabushiki Kaisha, Tokyo, Japan

[21] Appl. No.: 09/152,929

[22] Filed: Sep. 14, 1998

Related U.S. Application Data

[62] Division of application No. 08/857,979, May 16, 1997, abandoned.

[30] Foreign Application Priority Data

May 16, 1996 [JP] Japan ..... 8-146820
Oct. 9, 1996 [JP] Japan ..... 8-287626

[51] Int. Cl.[7] ..... D05B 57/26

[52] U.S. Cl. ..... 112/231

[58] Field of Search ..... 112/230, 231, 112/279, 278, 228, 229, 302, 180, 188, 196

[56] References Cited

U.S. PATENT DOCUMENTS

| | | | |
|---|---|---|---|
| 160,422 | 10/1926 | Poitevin et al. | 112/231 |
| 1,981,834 | 11/1934 | Fleckenstein | 112/231 |
| 2,690,726 | 10/1954 | Wener | 112/231 |
| 2,763,227 | 9/1956 | Howard | 112/231 |
| 2,817,307 | 12/1957 | Kuhar | 112/231 |
| 2,851,977 | 9/1958 | Spaine | 112/23 |
| 2,965,057 | 12/1960 | Lakin | 112/231 |
| 4,397,250 | 8/1983 | Zylbert et al. | 112/231 X |
| 4,679,513 | 7/1987 | Druffel | 112/231 X |
| 4,732,098 | 3/1988 | Mertel et al. | 112/231 X |
| 5,048,436 | 9/1991 | Thiele | 112/231 X |

FOREIGN PATENT DOCUMENTS

| | | | |
|---|---|---|---|
| 725083 | 11/1966 | Italy | 112/231 |
| 4417744 | 7/1969 | Japan . | |
| 4423020 | 7/1969 | Japan . | |

*Primary Examiner*—Ismael Izaguirre
*Attorney, Agent, or Firm*—Morgan & Finnegan LLP

[57] ABSTRACT

A bobbin case for accommodating a bobbin which has a shaft portion and a collar portion formed on both sides of the shaft portion on which a thread is wound, the bobbin case comprises: an opening being opened on at least one side of an axial direction of the shaft portion, for detachably accommodating the bobbin; a thread take-up portion provided in the axial direction opposite to the opening, for pulling out the thread of the bobbin; and a holding member which makes contact with the bobbin and nonrotatably holds the bobbin.

7 Claims, 7 Drawing Sheets

BOBBIN CASE AND BOBBIN OF SEWING MACHINE

This is a divisional of application No. 08/857,979 filed May 16. 1997, herein incorporated by reference and now abandoned.

BACKGROUND OF THE INVENTION

The present invention relates to a bobbin case for accommodating a lower-thread bobbin by setting it in the rotary hook base of a rotary hook portion in a lock stitch sewing machine and a lower-thread bobbin.

As a bobbin case to be set in the rotary hook base of a rotary hook portion in a lock stitch sewing machine, there are known two types: a so-called DB type of FIG. 3 in which a bobbin case is rotated counterclockwise as viewed from a rotary hook portion and a needle is located in the rear of a hook base and in front of a beak of a rotary hook body, and a so-called DP type of FIG. 7 in which a bobbin case is rotated clockwise as viewed from a rotary hook portion and a needle is located in the rear the beak of rotary hook body and in front of a needle guide provided on the back surface of the rotary hook. Members having functions common to both types are given like reference characters.

In these bobbin cases, an open groove 21*a* obliquely extending up to an edge portion is formed in the peripheral wall portion 21*b* of a body 21. Further, a tension spring 22 which has a thread guide portion 22*a* at its free end and whose spring pressure is adjustable with a screw 23 is fixed to the outer periphery of the peripheral wall portion 21*b* of the body 21. Further, a latch 24 for retaining the body 21 to a stud uprightly provided in the center of a rotary hook base (not shown) is installed on the outer face of the bottom portion 21*c* of the body 21.

In any one of these types, a general-type lower-thread bobbin 25 shown in FIG. 7 is installed inside and bobbin thread Y is wound on such a bobbin by a lower-thread winding unit (not shown) installed in a sewing machine. At this time, the leader of the bobbin thread is manually wound on the shaft 25*a* of the bobbin 25 several times.

When the bobbin case is set in a rotary hook base, the bobbin 25 on which the bobbin thread Y has been wound is mounted in the bobbin case body 21. Then the winding end portion of the bobbin thread Y is led to the lower face of a tension spring 22 via the open groove 21*a* and pulled out via the thread guide portion 22*a* in the direction of an arrow (upward because those shown in FIGS. 3 and 7 use a vertical rotary hook portion. When the sewing operation is performed after the bobbin 25 is mounted in the rotary hook portion, the bobbin thread Y is pulled out as the sewing operation progresses and the bobbin 25 is rotated in the pulling direction as shown by the arrow in those figures.

Although the aforementioned bobbin case is designed to accommodate the bobbin 25 on which bobbin thread Y has been wound, there has been proposed an arrangement in which a "coreless cop" wound like a doughnut through a special winding method is directly accommodated without using a bobbin in order to prevent thread from coming apart (Japanese Utility Model Publication Nos. Sho. 44-17744 and No. 44-23020). A system of taking out thread in the axial direction like this is called a "longitudinal take-up system."

The examples of pulling out the bobbin thread Y while the bobbin 25 is being rotated as shown in FIGS. 3 and 7 cause the tension tempered with the weight of thread, the weight of the bobbin 25 and the clamping force of the tension spring 22 to be applied to the bobbin thread Y. However, the weight of thread varies between a case where the thread is fully wound on the bobbin 25 and a case where it almost runs out. Consequently, the bobbin thread tension when the thread has almost run out becomes halved from when the thread has fully been wound thereon. When, moreover, the winding diameter is reduced as the wound thread amount decreases at the time of sewing, an angle of rotation of the bobbin 25 gradually increases, though the bobbin thread take-up amount remains unchanged. Therefore, the coefficient of dynamic friction between the bobbin and the stud uprightly provided in the center of the rotary hook base is reduced, so that the bobbin thread tension is gradually decreased. When the bobbin thread Y is rapidly pulled out during the time the rotary hook portion is operated at a speed as high as about 8,000 r.p.m. (rotations per minute) or at the time of thread cutting, the bobbin 25 is allowed to rotate because of inertia force after the thread pulling operation is stopped. The slackening of thread is caused in the bobbin case because the bobbin thread Y has been excessively pulled out, which results in tension variation. Consequently, a kink, this is, twisting is added to the slackened thread and the wound thread may fall apart. In this case, the kink may cause the tension spring 22 to be tampered with thread, which results in an extreme tension variation. As variation in the bobbin thread tension is led to the lowering and rising of the connecting position with the upper thread, the variation in the bobbin thread tension as described above may originate in non-uniform seam. Particularly in the case of white shirt sewing, the allowed fluctuation width of bobbin thread tension is extremely small and the seam appearance is seriously affected. Although some bobbin case is equipped with a spring for preventing bobbin racing in its rotary hook base, the spring force has caused the bobbin thread tension to increase.

When the bobbin thread Y wound on the bobbin 25 decreases in amount as the sewing operation progresses, the leader of the thread interferes with the bobbin thread that is being released, which may cause fluctuation in the bobbin thread tension and may result in having the thread cut off sometimes in a locked condition.

On the other hand, what is adapted for directly accommodating thread in such a manner that the "coreless cop" is pulling out from the central part of the rotary hook portion makes the bobbin thread tension free from fluctuating as shown in FIGS. 3 and 7 but lets a kink (where thread becomes entwined around adjoining one) occur when the quantity of thread decreases. Although the user usually winds bobbin thread on a lower-thread bobbin using a lower-thread winding unit attached to a sewing machine, the "coreless cop" cannot be wound up in that way, whereupon the user will have to request a special manufacturer to do so. Consequently, such a "coreless cop" has not come into wide use yet because the cost therefor tends to mount up.

SUMMARY OF THE INVENTION

An object of the present invention is to obviate the cause of fluctuations in bobbin thread tension in a bobbin case and a lower-thread bobbin in a sewing machine.

A bobbin case according to the present invention comprises means for nonrotatably holding a bobbin and a tension spring, wherein bobbin thread is vertically taken from the bobbin and pulled out via the tension spring.

Particularly in the bobbin case of a DP type, a thread passage groove for use in pulling out bobbin thread in such a way that the bobbin thread is not brought into contact with a needle thread loop may be formed by obliquely digging down the thread passage groove from the surface side of the bottom portion of a bobbin case body in a direction opposite to the direction in which a rotary hook is rotated.

The bobbin case may be arranged so that a cylindrical guide portion is uprightly provided in the center of the bottom portion of a bobbin case body, wherein the bobbin thread vertically taken out is led to the tension spring via the cylindrical guide portion.

The bobbin case may be arranged so that the means for nonrotatably holding the bobbin comprises a magnet provided in the bottom portion of the bobbin case body and a bobbin fixing pin which is projected from the bottom portion of the bobbin case body and fitted in the hole of the collar portion of the bobbin.

The bobbin case has a peripheral wall portion which is held in a posture-holding cylindrical portion provided on the outer peripheral portion of a rotary hook base.

The bobbin case of a sewing machine may have cutout portions which are formed in the peripheral wall portion.

The bobbin case may be such that a groove engaging with a projected portion in the posture-holding cylindrical portion is formed in the peripheral wall portion and by adjusting and forcing the tip of a latch to and into an opening formed on the collar side of the posture-holding cylindrical portion and then turning the latch in a direction opposite to the direction in which a rotary hook is rotated, the tip of the latch is made to engage with a groove adjacent to the opening and extending in the direction opposite to the direction in which the rotary hook is rotated.

The bobbin case may be such that the groove engaging with the projected portion in the posture-holding cylindrical portion is formed in the peripheral wall portion and that a slanting face extending from the surface side to the back surface side of the inner edge of the collar of the posture-holding cylindrical portion and slanting in the same direction of a face slanting toward the center side is formed at the tip of the latch.

A lower-thread bobbin has a slit extending from a shaft hole up to the edge, which slit is formed in a collar portion.

DETAILED DESCRIPTION OF THE PREFERRED EMBODIMENTS

Figure 1:
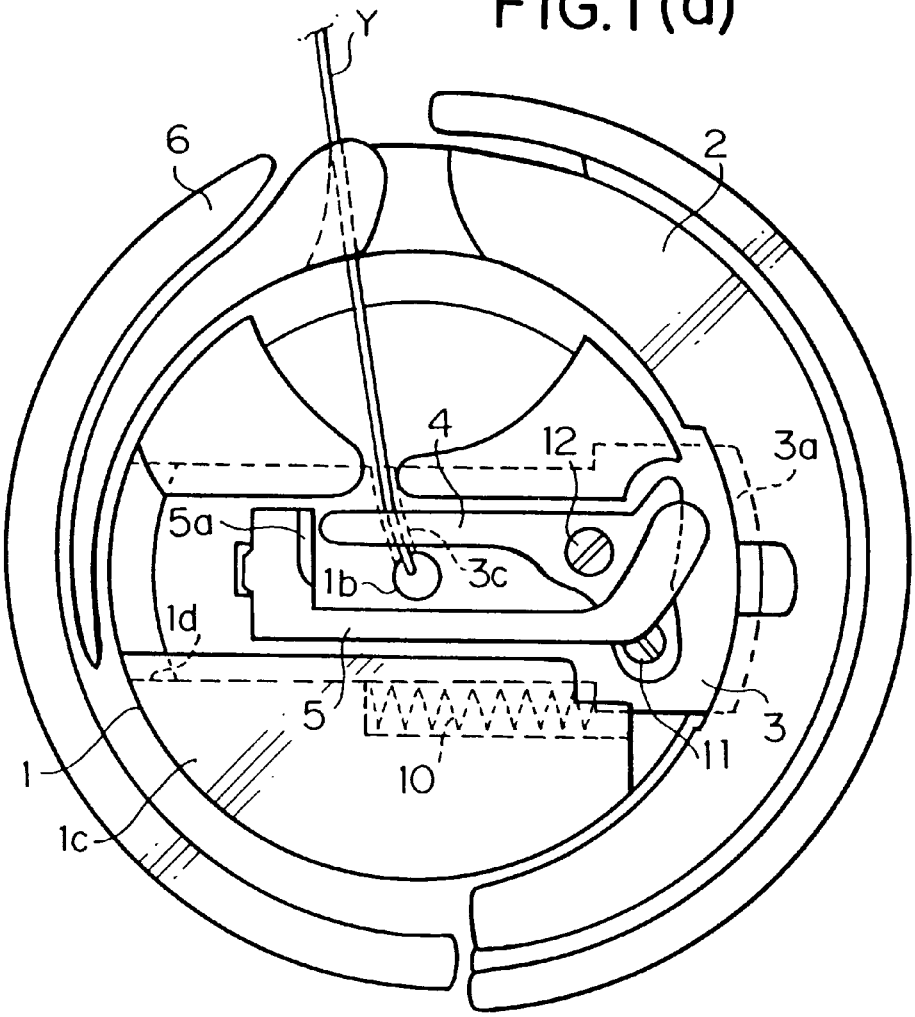
FIGS. 1(*a*) to 1(*b*) are diagrams illustrating a bobbin case of a DB type according to the present invention: 1(*a*) a plan view of a rotary hook portion fitted with a bobbin case; and 1(*b*) a vertical sectional view showing the relationship between the bobbin case and a rotary hook base.
Figure 1:
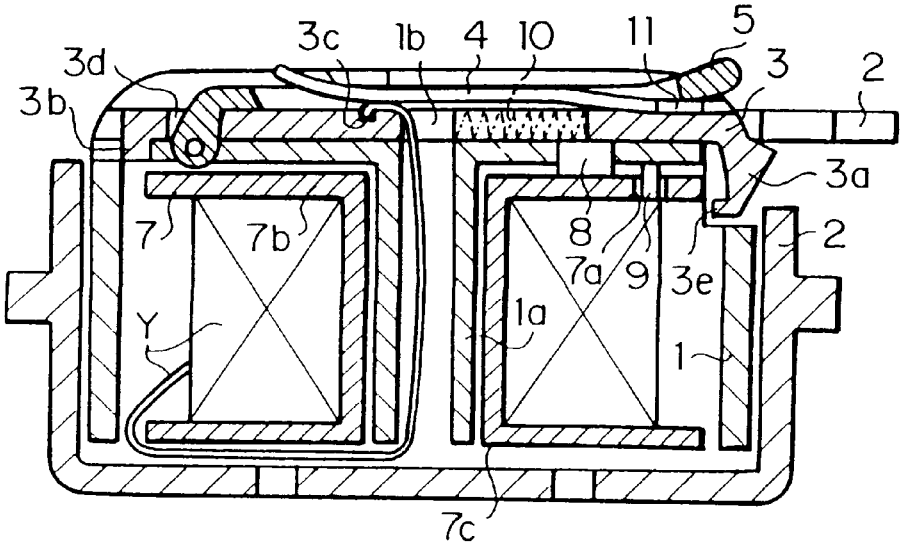
Figure 2A:
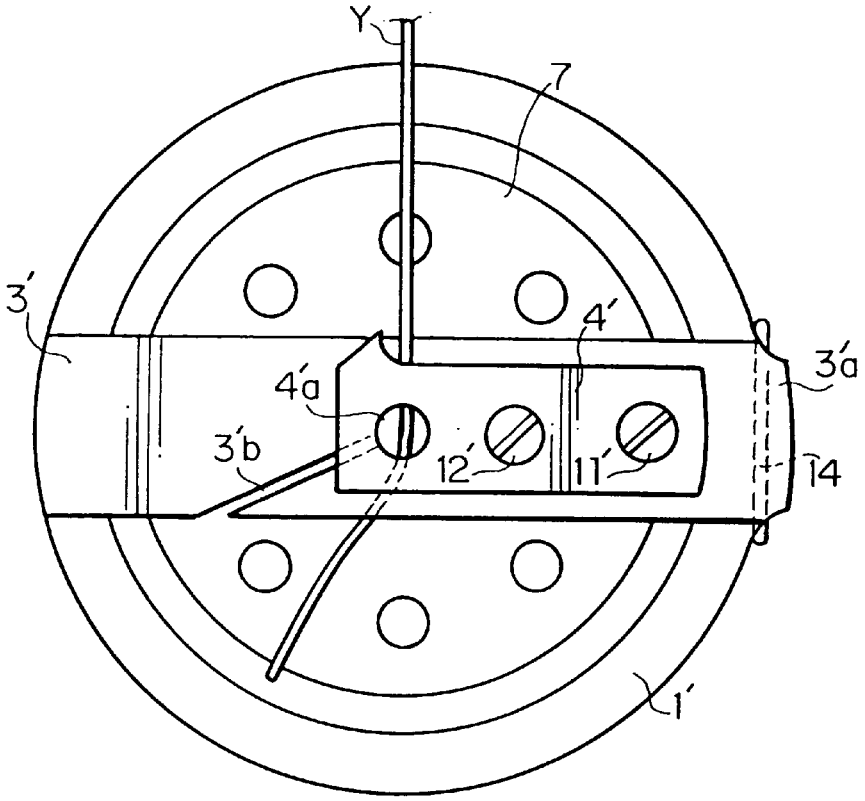
FIGS. 2(*a*) to 2(*b*) are diagrams illustrating another bobbin case of the DB type according to the present invention: 2(*a*) a plan view; and 2(*b*) a partial exploded side view.
Figure 2B:
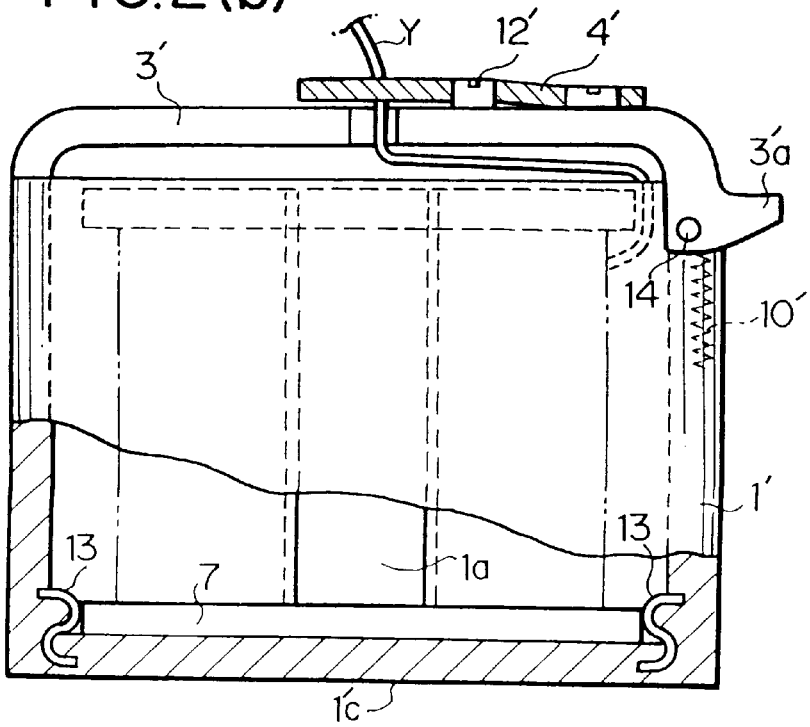
Figure 3A:
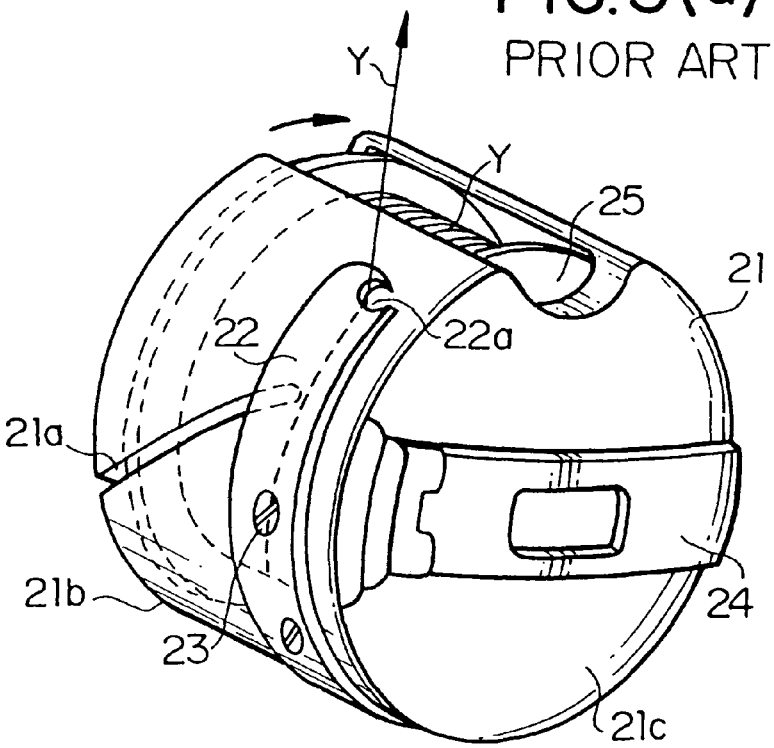
FIG. 3(a) PRIOR ART
FIGS. 3(*a*) and 3(*b*) are diagrams illustrating a conventional bobbin case of the DB type: 3(*a*) a perspective view; and 3(*b*) a side view.
Figure 3B:
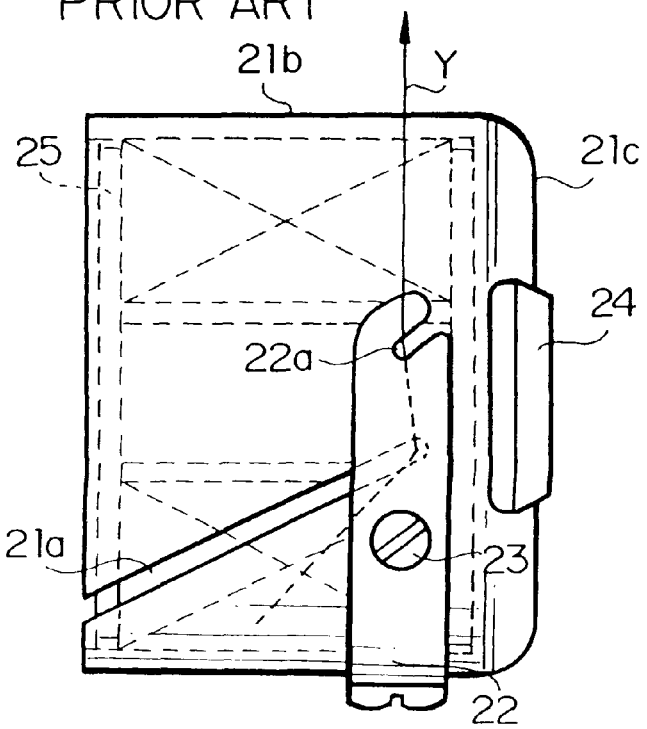
FIG. 3(b) PRIOR ART

Referring FIG. 1, there is given a description of a bobbin case as a first embodiment of the invention. Although what is described below is mounted in a vertical rotary hook portion of the DB type, a bobbin case may also be mounted in a horizontal rotary hook portion basically in the similar way.

This bobbin case has a bobbin case body 1 in a form like a turned-down bowl and a cylindrical hollow guide portion 1*a* is formed inside the bobbin case body 1, the hollow guide portion la passing through a hole 7*c* of a bobbin 7. A latch 3 for retaining the bobbin case in a rotary hook base 2 to be set is provided on the outer face of the bottom portion 1*c* of the body 1. The latch 3 is equipped with a tension spring 4 for giving tension to bobbin thread. Further, a withdrawal lever 5 for removing the set-in bobbin case from the rotary hook base 2 is provided for the bobbin case body 1. Reference numeral 6 in FIG. 1(*a*) denotes a rotary hook body; and 7 in FIG. 1(*b*) a bobbin on which bobbin thread Y is wound.

In the center of the bottom portion of the bobbin case body 1, the cylindrical guide portion 1*a* for mounting the bobbin is uprightly provided toward the opening side, the cylindrical guide portion 1*a* integral with the bottom portion thereof being also used as a bobbin thread passage. Consequently, a hole 1*b* is formed in the bottom portion of the body 1. Moreover, a magnet 8 for attracting and holding the bobbin 7 is embedded in the bottom portion of the bobbin case body 1, and a bobbin fixing pin 9 for stopping the rotation of the bobbin 7 by fitting in the small hole 7*a* bored in the collar of the bobbin 7 is projected therein.

One end portion of the latch 3 has a pawl portion 3*a* which engages with the set-in rotary hook base 2 of the bobbin case, whereas the other end portion is provided with a stopper portion 3*b* which mates with the bottom portion 1*c* of the bobbin case in such a manner as to regulate the projection limit of the pawl portion 3*a*. The latch 3 is slidably supported with a groove 1*d* which is formed on the outer face of the bottom portion 1*c* of the bobbin case body 1 and also urged toward the pawl portion 3*a* by a compression spring 10 installed with respect to the bobbin case body 1. The outer end portion of the pawl portion 3*a* is tilted. Consequently, the latch 3 is pushed back by the corresponding portion of the rotary hook base 2 when the bobbin case is forced in the rotary hook base 2 and can be reset by the force of the compression spring 10 when the bobbin case has completely pushed in. At this point of time, the latch 3 engages with the corresponding portion of the rotary hook base 2 and the set-up operation is completed. Moreover, the lower end portion of the latch 3 in FIG. 1(*b*) projects inside. This projecting portion 3*e* is moved to the inside of the upper collar portion 7*b* of the bobbin 7 and mates therewith when the withdrawal lever 5, which will be described later, is raised to move back the pawl portion 3*a* and released from engaging with the rotary hook base 2. When the bobbin case is detached, the bobbin 7 kept in engagement with the projecting portion 3*e*.

One end of the substantially L-shaped tension spring 4 is fixed to the latch 3 with a screw 11. The clamping pressure of the tension spring 4, that is, bobbin thread tension is made adjustable by pulling out the thread end to regulate the tightening condition of a thread tension regulating screw 12 with respect to the latch 3. A thread handling area regulating groove 3*c* is formed in the latch 3 in a position corresponding to the bobbin thread clamping position of the tension spring 4. Moreover, the free end of the tension spring 4 is curved upward to facilitate threading (FIG. 1(*b*)).

The base portion of the withdrawal lever 5 is rotatably supported with the bobbin case body 1 and extends toward the pawl portion 3*a* through a hole 3*d* bored in the latch 3. When the withdrawal lever 5 is raised, the latch 3 is moved against the force of the compression spring 10 because its back is mating with the edge of the hole 3*d* and pushed, and the pawl portion 3*a* is moved back from the position where the pawl portion 3*a* is kept engaging with the rotary hook base 2. In other words, the bobbin case can be removed from the rotary hook base 2. A chamfer portion 5*a* for facilitating threading is formed in a position of the withdrawal lever 5, that positing facing the free end of the tension spring 4; that is, the chamfer portion 5*a* together with the up-curved free end of the tension spring 4 forms a gap for use in threading.

With the bobbin case thus constructed, the withdrawal lever 5 is pulled up to remove the bobbin case from the rotary hook base 2 and the bobbin 7 is fitted to the cylindrical guide portion 1*a* with a predetermined amount of bobbin thread Y wound thereon. At this time, the collar portion 7*b* of the bobbin 7 is attracted by the magnet 8 and the bobbin fixing pin 9 is fitted in the small hole 7*a* to ensure that the bobbin 7 is set in the bobbin case body 1 in a nonrotating state. Then the end portion of the bobbin thread Y is passed between the inner peripheral face of the bobbin case body 1 and the bobbin 7, led into the cylindrical guide portion 1*a* along the collar of the bobbin 7 and pulled out of the hole 1*b*. The pulling of the thread in the axial direction of the bobbin is called the "longitudinal take-up" as mentioned above. Further, the thread end is led by the groove 3*c* between the latch 3 and the tension spring 4. When the bobbin case in this state is pushed into the rotary hook base 2, the pawl portion 3*a* of the latch 3 is pushed and moved back by the corresponding portion of the rotary hook base 2 and then caused to climb over the corresponding portion of the rotary hook base 2. When the bobbin case is reset by the force of the compression spring 10, the set-up operation is completed. A gap wide enough for the thread to pass therethrough is formed in this state between the bottom portion of the rotary hook base 2 and the collar of the bobbin 7. When a sewing operation is performed after the termination of threading any other portion as prescribed, the bobbin thread Y is drawn out as the sewing operation progresses. However, the bobbin 7 never rotates since the bobbin 7 is held in the body 1 in the nonrotating state and since the bobbin thread Y is drawn out as defined by the "longitudinal take-up."

Although the route of the bobbin thread Y according to the preceding embodiment of the invention is as described above, the bobbin thread Y may be taken up directly and longitudinally from the collar edge side above the bobbin 7; in order words, in a second embodiment of the invention, the following alteration will be needed, wherein like members performing functions similar to those in the preceding embodiment thereof are given like reference characters with "'" added thereto.

The bottom portion 1'*c* of a bobbin case body 1' is positioned entirely opposite to that according to the preceding embodiment of the invention and a plate spring 13 for nonrotatably fixing a bobbin 7 to the side opposite thereto in the inner part of the bottom portion 1'*c*. A latch 3' that can be opened and closed (swingable) is supported by a fulcrum pin 14 in the opening of the body 1' and as in the preceding embodiment of the invention, a latch 3' is installed with a pawl portion 3'*a* engaging with a rotary hook base and further a compression spring 10' for urging the latch 3' in a direction in which the latch 3' is closed is contained in the body 1'. Further, a tension spring 4' with a small hole 4'*a* bored on its free end side is provided for the latch 3', the function of the tension spring 4' being similar to what has been defined according to the preceding embodiment of the invention. A thread guiding slit 3'*b* extending up to the position of a small hole 4'*a* is formed in the latch 3'. Incidentally, the way of supporting the bobbin 7 by the plate spring 13 in place of the magnet and the pin is possible even in the preceding embodiment of the invention. However, the setting position of such a plate spring is a position close to the bottom portion 1'*c* of the body 1'. Similarly, a magnet and a pin may also be adopted according to this embodiment of the invention.

The aforesaid way of supporting the bobbin is satisfactorily usable for some kinds of thread though those of usable thread are restricted even in this embodiment of the invention because a kink occurs when the twisting of bobbin thread is strong as proved by experiments. Not only such a kink but also untwisting is not caused to occur on the whole in the preceding embodiment of the invention.

Figure 4A:
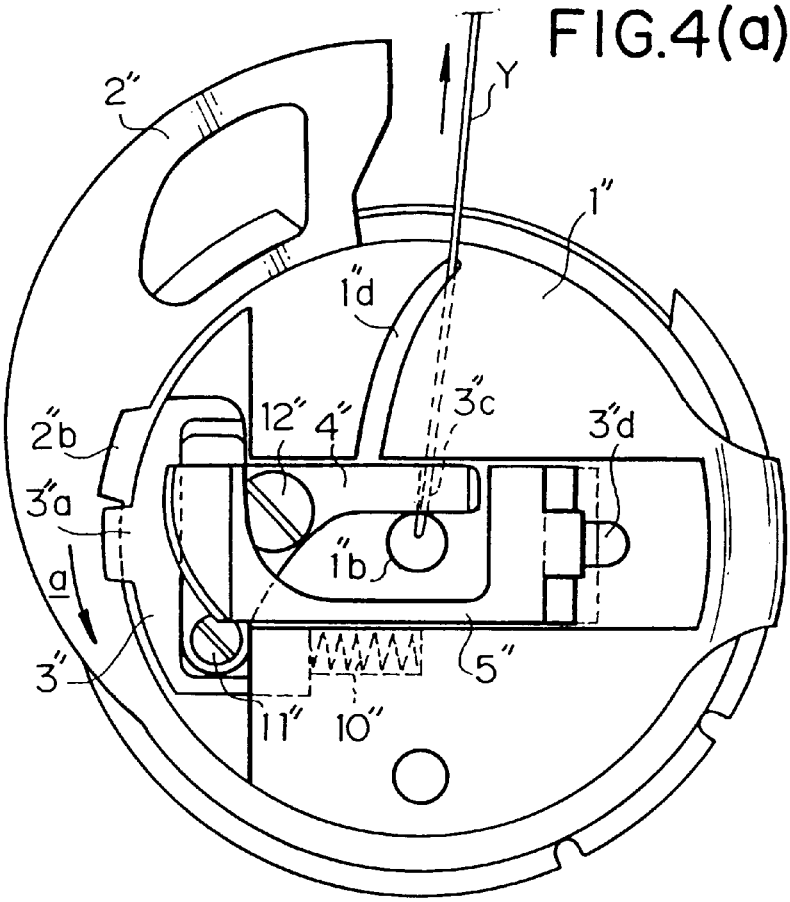
FIGS. 4(*a*) to 4(*c*) are diagrams illustrating a bobbin case of a DP type according to the present invention: 4(*a*) a plan view of a rotary hook portion fitted with a bobbin case; 4(*b*) a vertical sectional view showing the relationship between the bobbin case and an rotary hook base: 4(*c*) a partial sectional view showing a state of a hole.
Figure 4B:
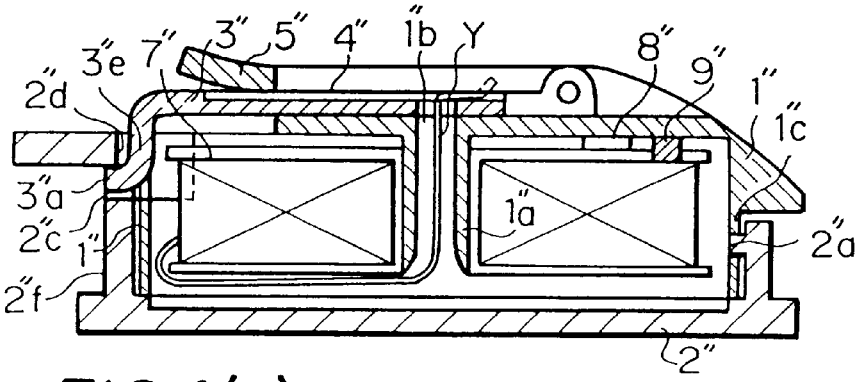
Figure 4C:
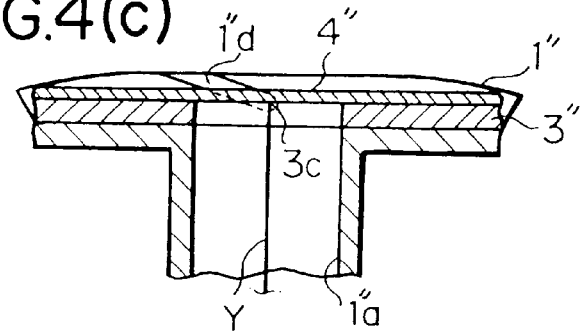

Referring FIG. 4, there is given a description of a bobbin case as a third embodiment of the invention. Although what is described below is mounted in a vertical rotary hook portion of the DP type, a bobbin case may also be mounted in a horizontal rotary hook portion basically in the similar way. In this third embodiment of the invention, which is not basically different from the first embodiment thereof, a difference in the direction of rotation makes it necessary to alter the member fitting positions and several points, wherein like members performing functions similar to those in the first embodiment thereof are given like reference characters with '"' added thereto, and those that have been altered will mainly be described.

Figure 8:
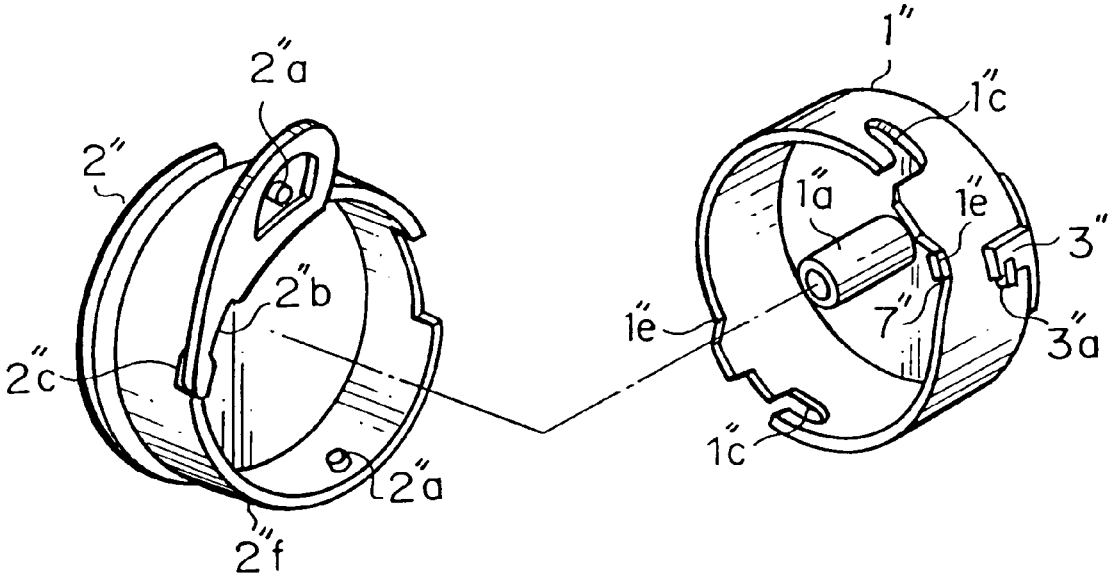
FIG. 8 is a perspective view of the bobbin case of the DP type and the rotary hook base according to the present invention.
Figure 9:
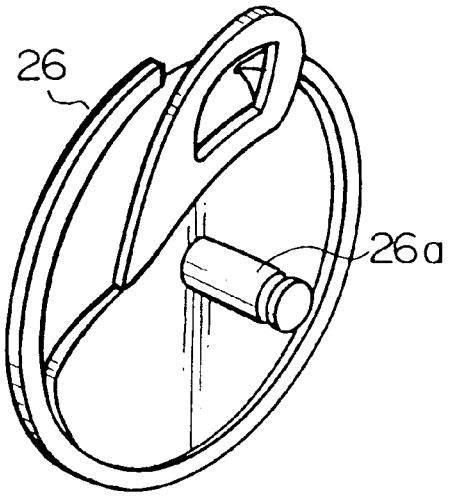
FIG. 9 is a perspective view of the conventional rotary hook base of the DP type.

In the case of a bobbin case according to the third embodiment of the invention, the bobbin-case mounting shaft 26*a* in the conventional rotary hook base 26 shown in FIG. 9 is absent. This is due to the fact that the presence of the bobbin-case mounting shaft makes it hard to pay out thread. Instead, a cylindrical portion 2"*f* surrounding the peripheral wall portion of a bobbin case 1" is newly installed as shown in FIG. 8 in order to hold the mounting posture of the bobbin case 1" mounted in a rotary hook base 2". This is also the case with the DB type shown in FIG. 1.

A groove 1"*c* having relatively much room in the peripheral direction is provided in the peripheral wall portion of a body 1", the groove 1"*c* engaging with a projection 2"*a* projected toward the inside of the peripheral side portion 2"*f* of the rotary hook base 2". The configuration of the groove 1"*c* is as shown in FIG. 8. The projection 2"*a* of the rotary hook base 2" and the groove 1"*c* of the body 1" are, as shown in FIG. 8, provided in two places in positions opposite to each other.

As shown in FIG. 8, further, cutout portions 1"*e* are formed in positions which are opposite to each other and deviate from the respective positions where the grooves 1"*c* are formed in the peripheral wall portion of the body 1". Without the cutout portions 1"*e*, a bobbin 7" mounted in the bobbin case 1" is hardly detachable because it is tightly attached to a magnet 8" and hidden by the outer peripheral edge of the bobbin case. According to the present invention, the bobbin 7" can simply be pulled out by picking up the bobbin 7" looking out the cutout portions 1"*e* with the tips of two fingers and hooking one of the collars.

Further, the body 1" is, as shown in FIG. 4, provided with a thread passage groove 1"*d* for use in pulling the bobbin thread by guiding it in such a way that it is not brought into contact with a needle thread loop creeping through the rotary hook portion. This thread passage groove 1"*d*, as shown in FIG. 4(*c*), slantly opens to the upper right from the left-hand side of a hole 1"*b* as viewed from the front and besides the inner part of the thread passage groove 1"*d* ranging from the hole 1 *b* up to its upper end is straightly linearized. In other words, the inner part of the thread passage groove 1"*d* is formed so that it is obliquely dug down from the bottom surface side in a direction opposite to the direction in which a rotary hook is rotated. As the edge of the rotary hook (not shown) is rotated clockwise, the needle thread hooked thereby is moved from right to left. Therefore, the needle thread loop is allowed to move smoothly in the thread passage groove 1"*d* and never interferes with the bobbin thread Y.

A projected portion 3"*a* bending from the surface side to the back surface side and projecting toward the outer peripheral side is provided at the tip of a latch 3". An opening 2"*b* for receiving the projected portion 3"*a* at the set-in time and a groove 2"*c* extending in a direction opposite to the direction (in the direction of an arrow a) in which the rotary hook is rotated are provided for the rotary hook base 2", the groove 2"*c* being adjacent to the opening 2"*b*. The opening 2"*b* and the groove 2"*c* exist on the side opposite to the diametric direction of the aforesaid projected portion 3"*a*.

The body 1" is set in the rotary hook base 2" by forcing in the body 1" in such a way as to fit the projected portion 3"*a* of the latch 3" to the opening 2"*b* of the rotary hook base 2" and then turning the body 1" in the direction of a. Although the bent outer wall portion 3"*e* of the latch 3" is moved back as it is pushed by the inner edge 2"*d* of the collar deviating toward the center of the rotary hook base 2", the latch 3" is kept pressed thereagainst by the restoring force of a compression spring 10".

Figure 5A:
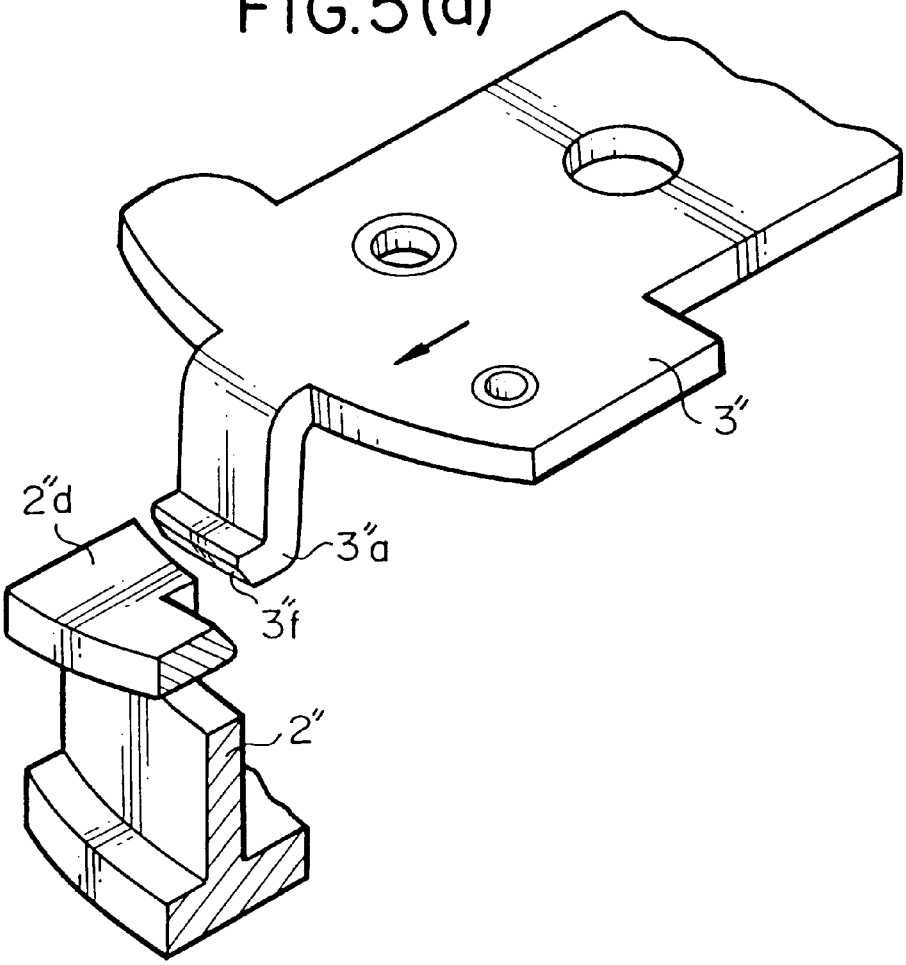
FIGS. 5(*a*) to 5(*b*) are diagrams illustrating the relationship between the latch and the rotary hook base in the bobbin case of the DP type: 5(*a*) a perspective view; and 5(*b*) a vertical sectional view.
Figure 5B:
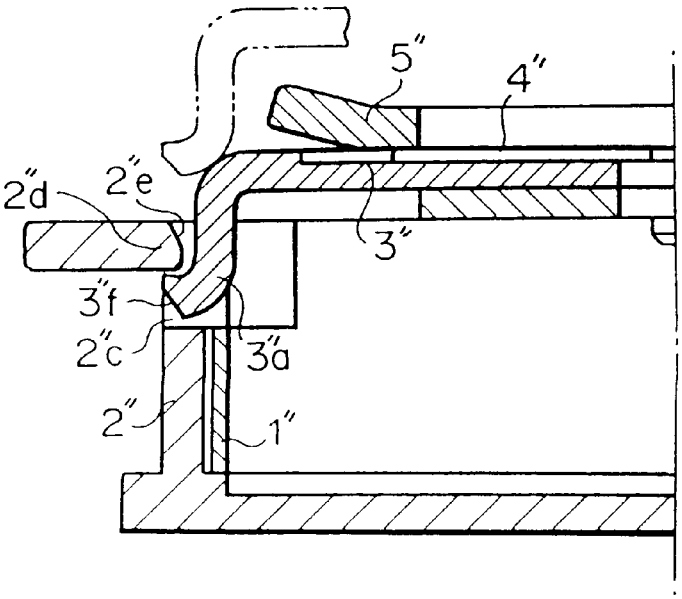
Figure 6:
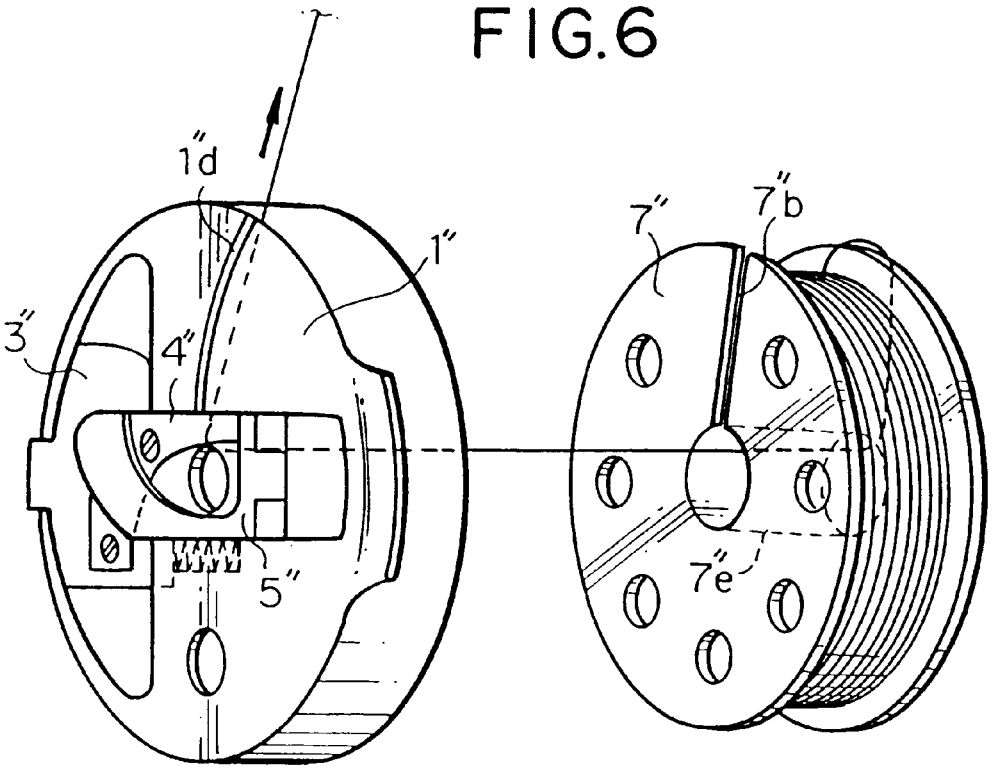
FIG. 6 is a perspective view of the bobbin case of the DP type and the lower-thread bobbin according to the present invention.
Figure 7:
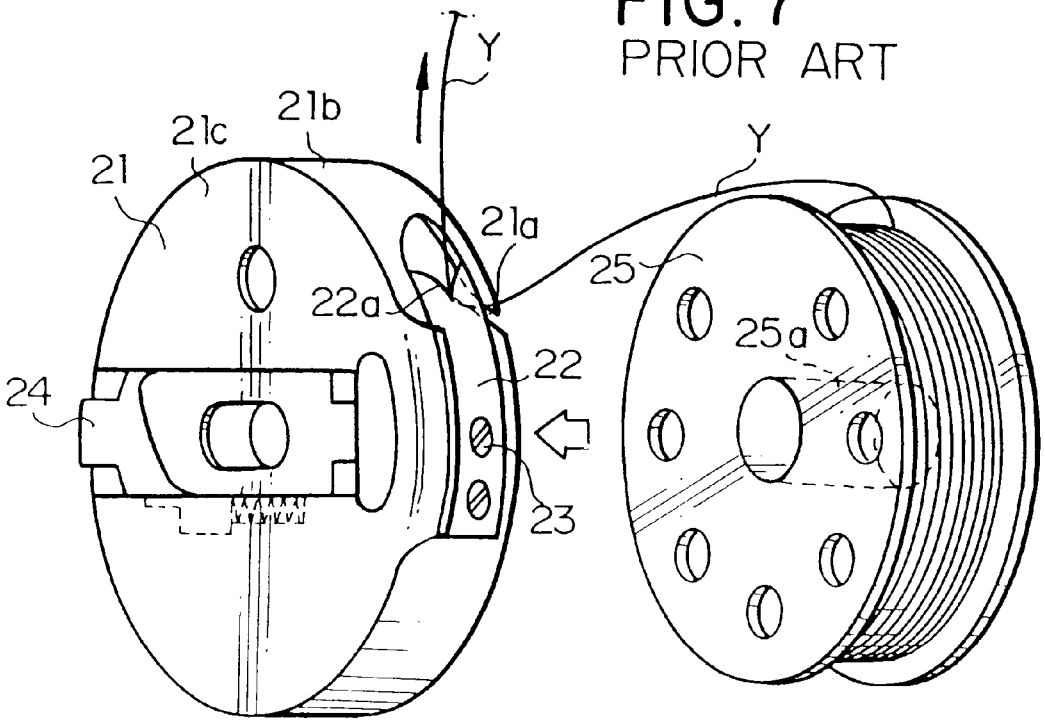
FIG. 7 PRIOR ART
FIG. 7 is a perspective view of the conventional bobbin case of the DP type and the lower-thread bobbin.

The relationship between the latch 3" and the rotary hook base 2" may be arranged as shown in FIGS. 5(*a*) and 5(*b*). More specifically, a slanting face 3"*f* extending from the surface side to the back surface side and tilting toward the center side, instead of the opening 2"*b* formed in the rotary hook base 2' as shown in FIG. 4(*a*), is formed at the tip of the projected portion 3"*a*. Further, a slanting face 2"*e* which slants in the same direction as the slanting face 3"*f* is also formed on the surface of the collar edge 2"*d* of the rotary hook base 2" facing the projection 3"*a* and the rear surface side is rounded. Consequently, the latch 3" positioned as shown by a chain line of FIG. 5(*b*) is forced into the body 1" when the body 1" is set to the rotary hook base 2", whereby the slanting face 3"*f* is moved back against the force of the compression spring 10" while contacting and sliding on the slanting face 2"*e* at the edge 2"*d* of the rotary hook base 2" and moved to the back of the edge 2"*d* of the rotary hook base 2" so as to be reset by the compression spring 10".

A description will lastly be given of the most suitable lower-thread bobbin 7" embodying the present invention.

The lower-thread bobbin 7" is what is provided with a slit 7"*b* in the collar portion of the conventional lower-thread bobbin, the slit 7"*b* extending from the hole of the shaft 7"*a* of the collar portion up to its edge.

A lower-thread winding unit attached to a sewing machine is used to wind bobbin thread on the lower-thread bobbin 7". This work is done through the steps of first mounting an empty lower-thread bobbin 7" in the predetermined position of the lower-thread winding unit, manually winding the leader portion of the thread pulled out of a lower-thread supply source on the shaft 7"*a* several times, and then pulling the leader out of the slit 7"*b* outside or keeping holding it during the operation of the lower-thread winding unit. In consequence, the leader of the bobbin thread is cut off at the edge of the slit 7"*b*, whereby the leader of bobbin thread is absent outside the lower-thread bobbin 7" on which the bobbin thread has been wound.

The lower-thread bobbin 7" with the leader of bobbin thread being not exposed outside is set in such a way that the slit 7"*b* side faces the bottom portion side of the bobbin case body 1" to perform the vertical take-up operation, whereupon even when the quantity of the bobbin thread Y wound on the bobbin thread Y decreases as the sewing operation progresses, the leader thereof is prevented from interfering with bobbin thread being released. Therefore the bobbin thread tension is set free from fluctuation and even from disconnection in the locked condition.

Supposing the lower-thread bobbin 7" formed with the slit 7"*b* is set in the conventional bobbin case 21 for sewing purposes, there would occur no problem arising from the exposure of the leader of bobbin thread; however, a slackening portion resulting from excessively pulling out the bobbin thread Y due to the inertia rotation of the bobbin at the time of high-speed operation and thread cutting may be caught by the slit 7"*b* and cut off. Therefore, the lower-thread bobbin 7" according to the present invention is not fit for use in the conventional bobbin case body 21.

According to the present invention, the bobbin thread is brought into contact with the collar portion without the slit 7"*b* and vertically taken up through the shaft 7"*a*. Therefore, the bobbin thread Y is never brought into contact with the slit 7"*b* and cut off in any case.

The present invention thus arranged as set forth above has the following effect:

Since tension is not affected by the lower-thread bobbin and the quantity of thread wound thereon, bobbin thread can be pulled out under constant regulated stress at all times. In the case where the slanting groove for preventing the bobbin thread from contacting the needle thread on the lower-thread passage, the bobbin thread can be guided to an optimum position. It is therefore possible to manufacture sewn products with uniform, beautifully finished seams. Further, any existing bobbin becomes usable and when the lower-thread bobbin with the slit formed in the collar portion is employed, the tension is set free from fluctuation until the wound bobbin thread is used up and the bobbin thread is prevented from disconnection. Further, the provision of the lower-thread bobbin designed not to rotate (race) in any case makes it unnecessary to choose an aluminum bobbin or a steel bobbin for the intended purpose and to take racing preventive measures by installing a racing preventive spring. Further, the bobbin case can be set simply by rotating or pressing it against the rotary hook base. Since the posture-holding cylindrical portion of the rotary hook base is held by the peripheral wall portion, moreover, the stability is kept unchanged as that of any other conventional one. The formation of the cutout portions for use in detaching the bobbin mounted on the peripheral wall portion also makes it easy to take out the bobbin.

What is claimed is:

1. A bobbin case of a bobbin having a core on which a bobbin thread is wound, for a sewing machine, comprising:

a bobbin case body;

means for nonrotatably holding the bobbin in the bobbin case body;

a tension spring, through which the bobbin thread is drawn from the bobbin in a direction parallel to the core, for applying a tension to the bobbin thread thus drawn; and a hollow-cylindrical guide portion uprightly extending from a center of a bottom portion of the bobbin case body to receive the core of the bobbin, wherein the bobbin thread taken out from the bobbin is led to the tension spring through the hollow-cylindrical guide portion.

2. The bobbin case according to claim 1, wherein said holding means comprises a magnet provided in a bottom portion of said bobbin case body and a bobbin fixing pin which projects from the bottom portion of said bobbin case body and fitted in a hole of a collar portion of the bobbin.

3. The bobbin case as claimed in claim 1, wherein said bobbin case has a peripheral wall portion having a groove engaging with a projected portion in a second cylindrical portion, and wherein by adjusting and forcing a tip of a latch to and into an opening formed on a collar side of said second cylindrical portion and then turning the latch in a direction opposite to the direction in which a rotary hook is rotated, the tip of the latch is made to engage with said groove, said groove being adjacent to the opening and extending in the direction opposite to the direction in which the rotary hook is rotated.

4. The bobbin case as claimed in claim 3, wherein said latch comprises a face extending from a surface side to a back surface side of an inner edge of the collar said surface slanting in the same direction as a face of said collar.

5. The bobbin case according to claim 1, wherein said bobbin case further comprises a peripheral wall portion in a second cylindrical portion provided on an outer peripheral portion of a rotary hook base.

6. A bobbin case for accommodating a bobbin which has a shaft portion and a collar portion formed on both sides of the shaft portion on which a thread is wound, said bobbin case comprising:

an opening formed in said case, said bobbin being placed such that one side of an axial direction of the shaft portion of the bobbin faces said opening, said opening detachably accommodating the bobbin;

a thread take-up portion provided opposite to said opening, for pulling out the thread of the bobbin; and a holding member which makes contact with the bobbin and nonrotatably holds the bobbin.

7. The bobbin case as claimed in claim 6, wherein said thread take-up portion of said bobbin case is disposed opposite to the shaft portion of the bobbin in said bobbin case with respect to the axial direction.

* * * * *

UNITED STATES PATENT AND TRADEMARK OFFICE

CERTIFICATE OF CORRECTION

PATENT NO. : 6,082,278

DATED : July 4, 2000

INVENTOR(S) : Asao, et. al.

It is certified that error appears in the above-identified patent and that said Letters Patent is hereby corrected as shown below:

Title page, item [73], Assignee: delete "Canon Kabushiki Kaisha" and insert therefor -- JUKI CORPORATION and HIROSE MANUFACTURING CO., LTD.--

Signed and Sealed this

Fourteenth Day of November, 2000

*Attest:*

*Attesting Officer*

Q. TODD DICKINSON

*Director of Patents and Trademarks*